US009410408B2

(12) United States Patent
Clark et al.

(10) Patent No.: US 9,410,408 B2
(45) Date of Patent: Aug. 9, 2016

(54) ELECTRICAL HEATING OF OIL SHALE AND HEAVY OIL FORMATIONS

(71) Applicant: SCHLUMBERGER TECHNOLOGY CORPORATION, Sugar Land, TX (US)

(72) Inventors: Brian Oliver Clark, Sugar Land, TX (US); Robert L. Kleinberg, Cambridge, MA (US); Nikita V. Seleznev, Cambridge, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 337 days.

(21) Appl. No.: 13/795,832

(22) Filed: Mar. 12, 2013

(65) Prior Publication Data

US 2014/0262221 A1 Sep. 18, 2014

(51) Int. Cl.
*E21B 43/24* (2006.01)

(52) U.S. Cl.
CPC ..... *E21B 43/2401* (2013.01)

(58) Field of Classification Search
CPC ..... E21B 43/16; E21B 43/24
See application file for complete search history.

(56) References Cited

U.S. PATENT DOCUMENTS

| | | | | |
|---|---|---|---|---|
| 3,782,465 | A | 1/1974 | Bell et al. | |
| 3,948,319 | A | 4/1976 | Pritchett | |
| 4,037,655 | A | 7/1977 | Carpenter | |
| 4,199,025 | A | 4/1980 | Carpenter | |
| 4,228,853 | A * | 10/1980 | Harvey et al. | 166/248 |
| 4,926,941 | A | 5/1990 | Glandt et al. | |
| 7,322,409 | B2 | 1/2008 | Wittle et al. | |
| 8,196,658 | B2 | 6/2012 | Miller et al. | |
| 2006/0151166 | A1 | 7/2006 | Montgomery et al. | |
| 2009/0008079 | A1 | 1/2009 | Zazovsky et al. | |
| 2010/0101793 | A1 * | 4/2010 | Symington et al. | 166/302 |
| 2011/0277992 | A1 | 11/2011 | Grimes | |
| 2013/0255936 | A1 * | 10/2013 | Geilikman et al. | 166/248 |

OTHER PUBLICATIONS

Gurevich et al., "Modeling elastic wave velocities and attenuation in rocks saturated with heavy oil," Geophysics, Jul.-Aug. 2008, vol. 73(4): pp. E115-E122.

(Continued)

*Primary Examiner* — William P Neuder
(74) *Attorney, Agent, or Firm* — Kenneth L. Kincaid

(57) ABSTRACT

A method (and system) is provided that enhances production of hydrocarbons from a subterranean formation by identifying at least one target interval of the subterranean formation that is in proximity to a pay interval, wherein the at least one target interval has an electrical resistance less than electrical resistance of the pay interval. A plurality of electrodes are placed in positions spaced apart from one another and adjacent the at least one target interval. Electrical current is injected into the target interval by supplying electrical signals to the plurality of electrodes. The electrical current injected into the at least one target interval passes through at least a portion of the at least one target interval in order to heat the at least one target interval and heat the pay interval by thermal conduction for enhancement of production of hydrocarbons from the pay interval.

21 Claims, 10 Drawing Sheets

(56) References Cited

OTHER PUBLICATIONS

Lienhard et al., "Chapter 4: Analysis of heat conduction and some steady one-dimensional problems," A Heat Transfer Textbook, Third Edition, Phlogiston Press: Massachusetts, 2008: pp. 141-191.

Wang et al., "Thermal Diffusivity of Green River Oil Shale by the Laser-Flash Technique," Thermochimica Acta, 1979, vol. 28: pp. 23-35.

International Search Report and Written Opinion issued PCT/US2014/023871 on Jul. 14, 2014, 18 pages.

* cited by examiner

ELECTRICAL HEATING OF OIL SHALE AND HEAVY OIL FORMATIONS

BACKGROUND

1. Field

The present application relates to methods and systems for heating subterranean hydrocarbon formations.

2. State of the Art

The term "oil shale" is a misnomer because the organic phase is not oil, but kerogen that has never been exposed to the temperatures and pressures required to convert organic matter into oil. It is estimated that there is roughly 3 trillion barrels of potential shale oil in place, which is comparable to the original world endowment of conventional oil. About half of this immense total is to be found near the common borders of Wyoming, Utah, and Colorado, where much of the resource occurs at reasonable saturation of at least 30 gallons/ton (roughly 0.25 v/v) in beds that are 30 m to 300 m thick. Oil shales are found relatively near the surface, ranging from outcrops down to about 1000 m.

The most common oil shale production technology to date involves mining the shale and retorting it at the surface. This requires rapidly heating the oil shale to 500° C., upgrading the produced shale oil in downstream refineries, and disposing of vast quantities of spent rock or sediment. These steps have significant economic and environmental problems. Another oil shale production technology involves in-situ conversion where the reservoir is slowly heated to a temperature that converts the kerogen to oil and gas. Petroleum produced by in-situ conversion is a good quality refinery feedstock requiring no further upgrading. Waste products remain underground, minimizing environmental impacts.

Several electrical methods have been proposed to heat oil shale formations, but none have gained widespread acceptance. Shell Oil Company has proposed the use of electrically heated rods inserted into boreholes in the oil shale formation. These rods transfer heat to the borehole, and the heat then diffuses into the surrounding formation. This method has the virtue of simplicity, since the production of heat is precisely controlled. However, this method has several problems. FIG. 1 shows the limitations of thermal diffusion in heating earth formations from within a borehole. The borehole is quickly heated to 350° C. (623 K) as depicted by the t0 line. Heat diffuses into the formation and the resulting temperature profiles are shown for one month intervals. After six months, significant heating is still confined to within a few meters of the borehole. Because the thermal diffusivity of the earth is quite low, it requires several months for the heat to spread just a few meters distance from the wellbore. Moreover, heat must be applied very slowly to prevent overheating the borehole and the oil shale in the immediate vicinity of the borehole.

Texaco and Raytheon experimented with a monopole antenna radiating at a frequency of a few megahertz. The antenna radiates vertically-polarized electric field from the borehole into the formation. This field drives a current which is proportional to electrical conductivity of the medium. Heating is due to ionic conduction in water or, less commonly, electronic conduction in metallic minerals. However, hydrocarbons in contact with water quickly come to pore-scale thermal equilibrium via heat conduction. An advantage of electromagnetic heating over heating via a resistive element in the borehole is that electromagnetic heating is distributed in the formation. The heating is not uniform, but is greatest where the electric field and electrical conductivity are greatest. The electric field drops off inside the formation due to geometrical spreading and the skin effect. FIG. 2 illustrates electromagnetic skin depth as a function of frequency and formation electrical resistivity for a formation with a dielectric constant of 10. For a frequency of 3 MHz and a formation resistivity of 10 ohm-m, the skin depth is about 1 m. The penetration of electromagnetic waves is deeper in the vadose zone above the water table, where, for example, the resistivity of the formation is in the range of 100-1000 ohm-m. The skin depth also increases if formation water is vaporized. The skin depth is limited in many applications, which increases the costs for field development and reduces the economic viability of the electromagnetic heating approach.

The term "heavy oil" refers to crude oil which does not flow easily. It is referred to as "heavy" because its density or specific gravity is higher than that of light crude oil. Heavy crude oil has been defined as any liquid petroleum with an API gravity less than 20°. Physical properties that differ between heavy crude oil and lighter grades include higher viscosity and specific gravity, as well as heavier molecular composition. Natural bitumen from oil sands is a type of heavy crude oil with an API gravity of less than 10°. Production, transportation, and refining of heavy oil present special challenges compared to light crude oil. Efficient production of heavy oil requires raising the temperature of the formation to reduce the viscosity of the heavy oil. Steam is commonly used for this purpose. However, there are many circumstances in which steam is difficult or impossible to use. In some cases, the heavy oil formations are very shallow, and steam would readily break through to the earth's surface and escape. In other cases, heavy oil formations are found in deepwater plays, where it is infeasible to maintain the temperature of steam as it is pumped down from a generating unit at the sea surface.

SUMMARY OF THE INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

A method (and system) is provided that enhances production of hydrocarbons from a subterranean formation having a plurality of intervals. The method (and system) identifies at least one target interval of the subterranean formation that is in proximity to a pay interval, wherein the at least one target interval has an electrical resistance less than electrical resistance of the pay interval. A plurality of electrodes are placed in respective positions spaced apart from one another and adjacent the at least one target interval. Electrical current is injected into the at least one target interval by supplying electrical signals to the plurality of electrodes. The electrical current injected into the at least one target interval passes through at least a portion of the at least one target interval in order to heat the at least one target interval and heat the pay interval by thermal conduction for enhancement of production of hydrocarbons from the pay interval.

In one embodiment, the electrodes are supported by corresponding downhole tools that are located in distinct wellbores at positions adjacent the at least one target interval. At least one of the electrodes can be configured to contact mudcake lining a respective wellbore. Alternatively, at least one of the electrodes can be configured to extend through such mudcake toward the uninvaded zone of the target interval. At least one of the downhole tools can include a pad that is configured to contact mudcake lining a respective wellbore and to surround a corresponding electrode during current injection operations.

In one configuration, the electrodes can be positioned adjacent a target interval that extends therebetween. A large portion of the injected electrical current can flow through the formation along a path that extends generally parallel to bedding of this target interval.

In another configuration, the electrodes can be positioned adjacent two distinct target intervals that straddle the pay interval. A large portion of the injected electrical current can flow through the formation along a path that extends generally parallel to bedding of the two distinct target intervals and that also extends generally perpendicular to bedding of the pay interval.

In one embodiment, the electrical signals supplied to the electrodes comprise AC electrical signals. The AC electrical signals can have a frequency less than 100 HZ (such as a frequency in the range of 50 Hz to 60 Hz).

In one application, the pay interval can include kerogen, and the heating of the pay interval can be sufficient to convert in-situ the kerogen of the pay interval to shale oil and hydrocarbon gases. In another application, the pay interval includes heavy oil, and the heating of the pay interval is sufficient to reduce in-situ the viscosity of the heavy oil. In either application, the least one target interval can hold connate water to provide a low resistance path for the injected current and the desired heating.

DETAILED DESCRIPTION OF THE PREFERRED EMBODIMENTS

According to one embodiment of the present application, a methodology (and system) is provided for in-situ conversion of kerogen within a kerogen rich zone of a subterranean formation into shale oil and gas phase hydrocarbons through heating of at least one adjacent lower resistance zone of the formation. The heating is accomplished by AC current injection into and through the adjacent lower resistance zone(s). The heat deposited into the adjacent lower resistance zone(s) is transferred by conduction (also referred to as "diffusion") to the kerogen rich zone in order to heat the kerogen to a temperature where the kerogen is converted into shale oil and gas phase hydrocarbons.

The system and methodology assumes that the subterranean formation has been analyzed to identify the kerogen rich zone (referred to herein a "pay interval") of relatively high kerogen content within the formation as well as at least one lower resistance zone (referred to herein as a "target interval) that is adjacent to or otherwise in proximate to the pay interval. The target interval has a lower resistivity than the resistivity of the pay interval and thus is better suited for current injection. The target interval can hold connate water or other suitable electrically conductive matter. The formation analysis that identifies the pay interval and the at least one target interval can involve downhole analysis involving wireline testing, logging while drilling, measurement while drilling or other suitable methods. Such formation analysis can also involve core sampling and analysis.

Figure 3:
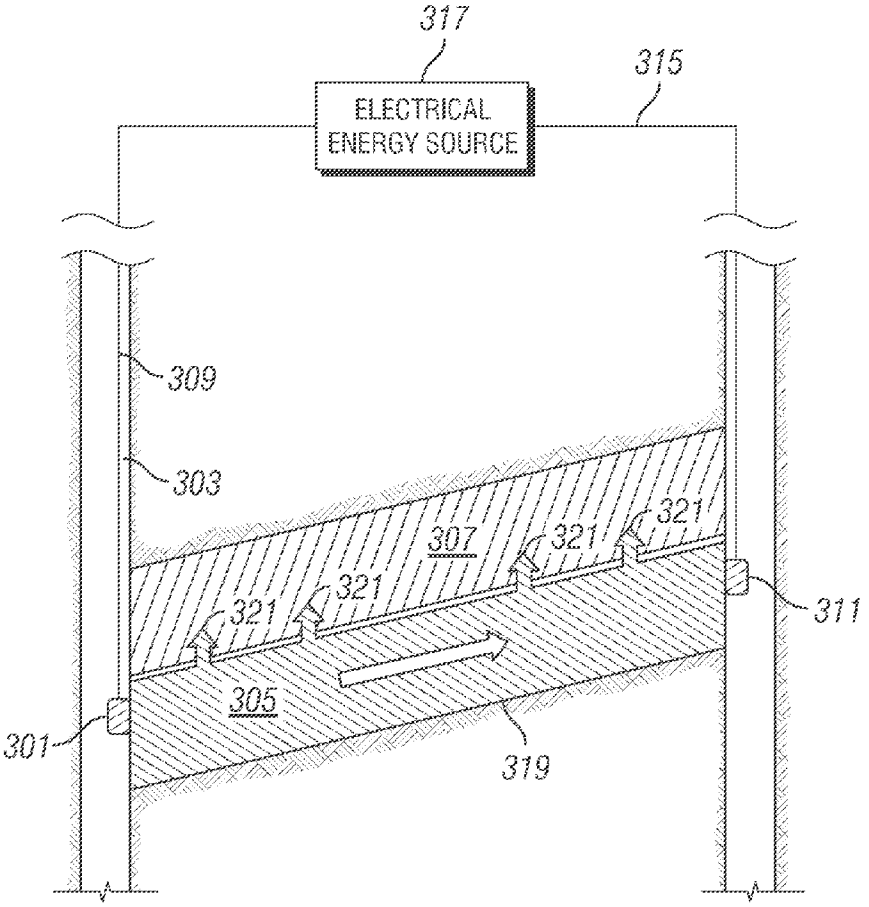
FIG. 3 is a schematic diagram illustrating an exemplary embodiment of a method and system that employs downhole tools to heat a subterranean shale formation for in-situ conversion of kerogen to shale oil and hydrocarbon gases in accordance with the present application.

As shown in FIG. 3, two wellbores (referred to herein as first wellbore 303 and second wellbore 313) are drilled through the formation and completed such that the wellbores intersect the target interval at locations that are spaced apart from one another. The target interval is labeled 305 and the pay interval is labeled 307. A first downhole tool 301 is positioned in the first wellbore 303. The first downhole tool 301 has an electrode that can be configured to inject electrical current into the target interval 305 for heating kerogen in the pay interval 307. The electrode is electrically coupled to one or more electrical conductors 309 that extend through the first wellbore 303 to the surface. For the case where an open hole completion completes the target interval, the electrode can be configured to contact mudcake lining the wall of the first wellbore 303. An insulating pad can surround the electrode and electrically insulate the electrode from direct electrical contact with other parts of the formation (other than the mudcake). The mudcake can provide a flow barrier that inhibits the flow of flow of fluid between the first wellbore 303 and the target interval.

Figure 1:
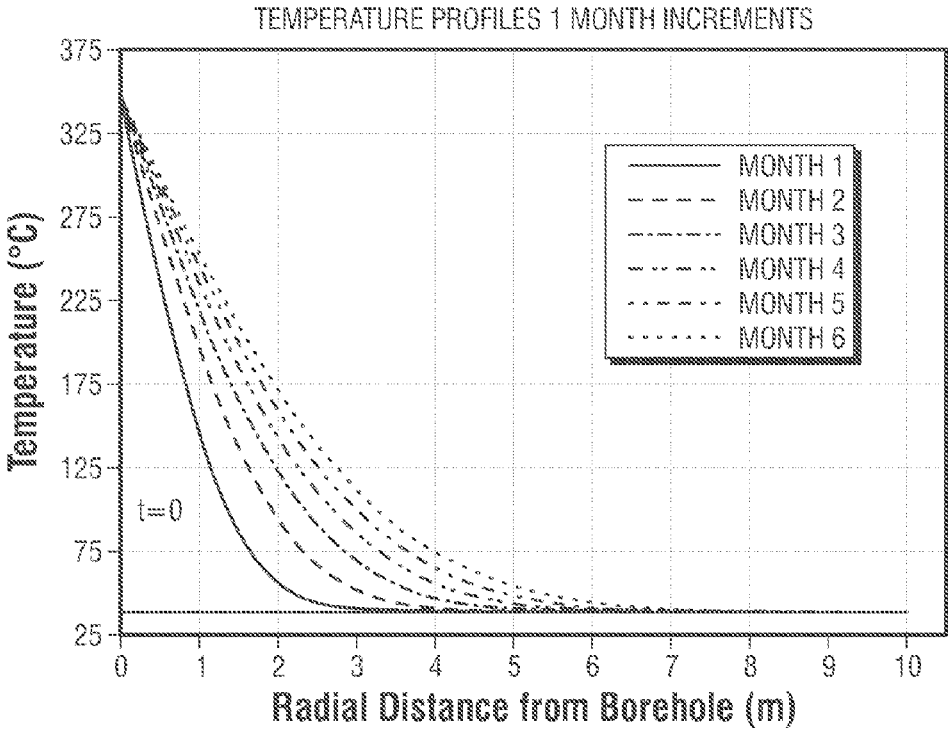
FIG. 1 (Prior Art)
FIG. 1 is a graph showing heating temperature as a function of radial distance from borehole over time for a prior art method where electrically heated rods are inserted into the borehole that traverses an oil shale formation.
Figure 2:
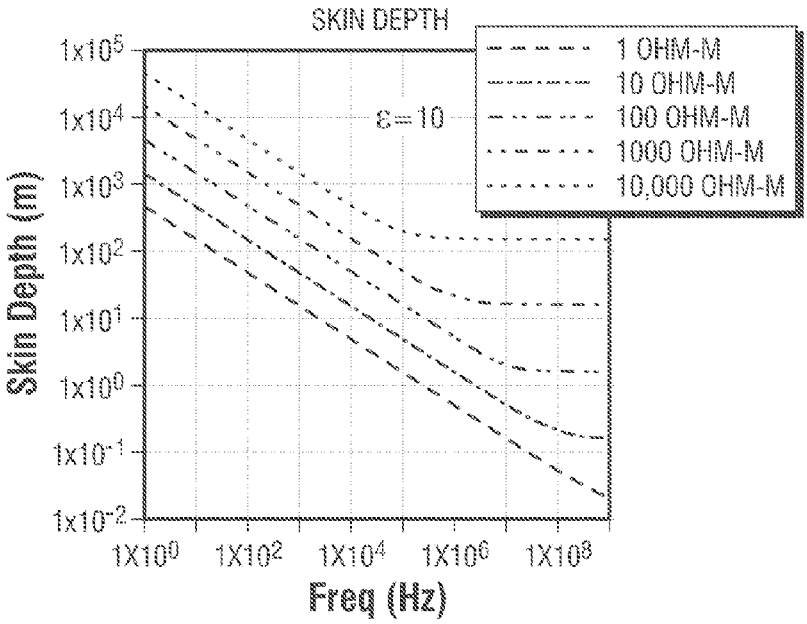
FIG. 2 (Prior Art)
FIG. 2 is a graph showing skin depth as a function of RF frequency for different formation resistivities for a prior art method where electromagnetic energy is injected into a formation for heating the formation.
Figure 4A:
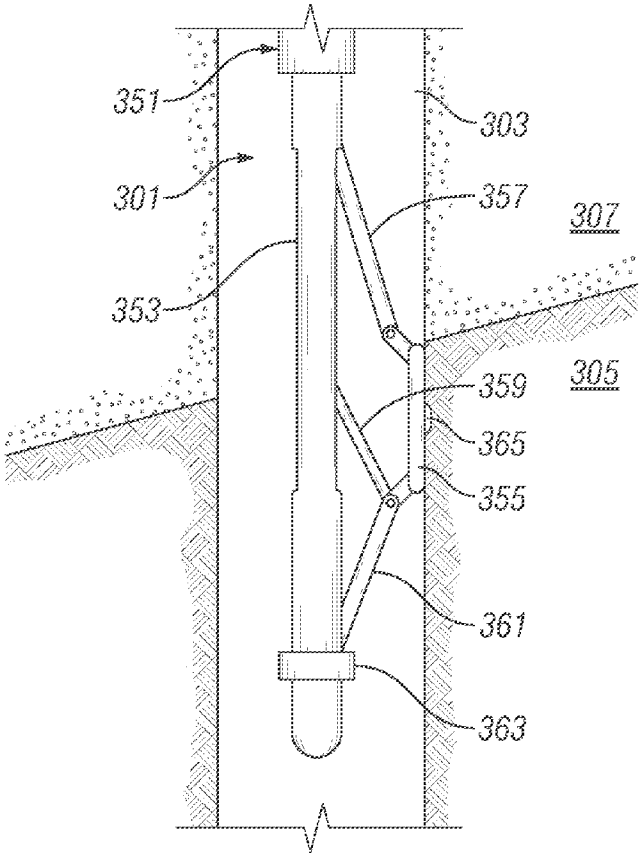
FIG. 4A is a schematic diagram illustrating an exemplary electrode configuration for the downhole tools of FIG. 3.

An exemplary embodiment of the downhole tool located in the first wellbore 301 is shown in FIG. 4A. The downhole tool 301' includes an elongate conveyance member 351 that is adapted to be moved through the wellbore 303. The upper end of member 351 is connected by conveyance means (such as a wireline cable or coiled tubing or drill pipe) to suitable apparatus at the surface for moving (raising and lowering) the conveyance member 351 within the wellbore 303. The downhole tool 301' further includes a tool body 353 supported below the member 351. A pad member 355 is adapted to be pushed outwardly and away from the tool body 353 toward the wall of the wellbore 303. To accomplish this, support arms 357, 359, 361 are pivotably coupled to the pad member 355 by suitable hinge means. The lower support arm 361 is pivotably coupled to a slidable collar member 363. Suitable actuating means is contained within the tool body 353 to urge the support members outward to thereby urge the pad member 355 against the wellbore wall, and to reverse this deployment process. The pad member 355 is made of a suitable wear resistance and electrically insulating material. An electrode 365 is secured to a central portion of the pad member 355 and faces outward away from the tool body 353 such that when the pad member 355 contacts the wall of the wellbore 303, the electrode 365 makes physical contact with the wall of the wellbore 303. The electrode 365 can include an element, such as knife edge or plow, that cuts through mudcake lining the wellbore 303 toward the uninvaded zone of the target interval. An insulated electrical conductor extends through (or along) one of the support arms (for example, support arm 357) and terminates at the electrode 365. Such conductor is electrically connected to the conductor 309 that extends to the surface-located electrical energy source 317 to provide for an electrical conductive path therebetween.

Figure 4B:
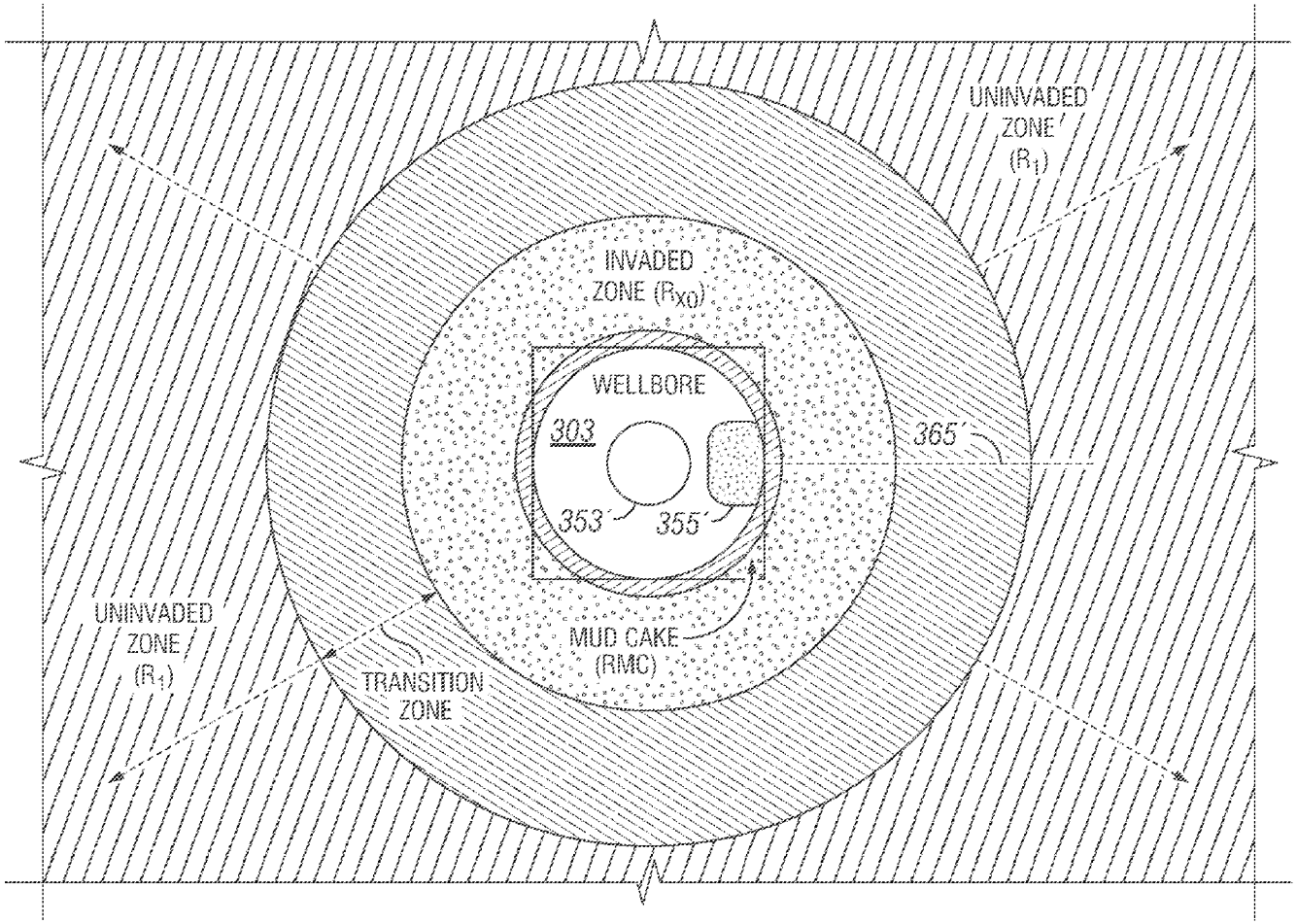
FIG. 4B is a schematic diagram illustrating another exemplary electrode configuration for the downhole tools of FIG. 3.

In an alternative embodiment as shown in FIG. 4B, the electrode 365' of the downhole tool located in the first wellbore 301 can extend away from the pad member 355' into and preferably through the mudcake into the invaded zone and possibly further into and through the transition zone and into the uninvaded zone as shown. The terminal end of the electrode 365' can be configured with a drill bit to assist in advancement of the terminal end into the formation. This configuration can be useful for wells that were drilled with non-conductive oil-based mud.

In yet other alternate embodiments, the electrode of the downhole tool located in the first wellbore 301 can be positioned inside the first wellbore 301 at the level of the target interval where fluid such as drilling mud fills the wellbore 301.

Referring back to FIG. 3, a second downhole tool 311 is positioned in the second wellbore 313. The second downhole tool 311 has an electrode that can be configured to inject electrical current into the target interval 305 for heating kerogen in the pay interval 307. The electrode is electrically coupled to one or more electrical conductors 315 that extend through the second wellbore 313 to the surface. For the case where an open hole completion completes the target interval, the electrode can be configured to contact mudcake lining the wall of the second wellbore 313. An insulating pad can surround the electrode and electrically insulate the electrode from direct electrical contact with other parts of the formation (other than the mudcake). The mudcake can provide a flow barrier that inhibits the flow of fluid between the second wellbore 313 and the target interval.

Exemplary embodiments of the downhole tool located in the second wellbore 313 are shown in FIGS. 4A and 4B. In yet other alternate embodiments, the electrode of the downhole tool located in the second wellbore 313 can be positioned inside the second wellbore 313 at the level of the target interval where connate water of the target interval fills the wellbore 313. This configuration can be useful for wellbores completed with liners, perforated casings or other suitable completions that allow for the connate water to flow from the target interval and fill the inside of the wellbore adjacent the target interval.

The conductors 309, 315 for the two electrodes of the first and second downhole tools 301, 311 are electrically connected to an electrical energy source 317. The electrical energy source 317 is configured to supply an AC electrical signal to the two electrodes of the first and second borehole tools 301, 311 via the conductors 309, 315 that extend through the respective boreholes. The AC electrical signal has a frequency preferably in a frequency range less than 100 HZ (more preferably in the range of 50 Hz to 60 Hz typical of mains electrical power). The AC electrical signal supplied to the two electrodes induces an AC current flow (depicted by arrow 319) that flows between the two electrodes into and at least partially through the target interval 305.

A large part of the AC current flowing between the two electrodes of the first and second borehole tools 301, 311 travels along the path of least resistance through the formation. It is contemplated that some AC current flow can travel along other higher resistance path(s) through the formation. In one embodiment, the path of least resistance through the formation involves a path solely through the target interval 305 without passing through other parts of the formation. In this case, the AC current flow that travels along this path through the target interval 305 heats the target interval 305, and such heat transfers through the formation by conduction (depicted by arrows 321) to heat the pay interval 307. For the case where the target interval 305 holds connate water, the electrical current flow heats the target interval 205 primarily by ohmic heating of the conductive connate water.

The AC electrical supply signal can be generated and supplied by the electrical energy source 317 in a continuous manner (or near continuous manner) to the two electrodes of the first and second downhole tools 301, 311 for an extended period of time in order to heat kerogen of the pay interval 307 to a sufficient temperature to convert the kerogen into shale oil (a synthetic crude oil) and gas phase hydrocarbons. For example, the pay interval 307 can be heated to about 350° C. at which point the kerogen of the pay interval 307 is converted to shale oil and gas phase hydrocarbons. The shale oil and gas phase hydrocarbons can be produced from the formation employing a suitable production methodology. The production methodology can employ one or more vertical (and/or horizontal) production wells that allow for production of the shale oil and gas phase hydrocarbons from the formation. Alternatively, the wellbore(s) that contain the current injection tools can be configured to provide for production of the shale oil and gas phase hydrocarbons from the formation.

In alternate embodiments, it is contemplated that electrical energy source can generate and supply pulsed-mode DC signals in a continuous manner (or near continuous manner) to the two electrodes of the first and second downhole tools 301, 311 for an extended period of time in order to inject pulsed-mode DC current into the target interval 305 that produces heat that diffuses and heats the kerogen of the pay interval 307 to a sufficient temperature to convert the kerogen into shale oil (a synthetic crude oil) and gas phase hydrocarbons.

The heat introduced into the target interval 305 spreads across the formation according to the well-known diffusion equation [see e.g., Lienhard and Lienhard, A Heat Transfer Textbook, 3rd ed., Phlogiston Press, 2008, chap. 4] as follows:

$$\frac{\partial T}{\partial t} = \nabla \cdot (\kappa \nabla T) + \Theta \tag{1}$$

where T is the temperature of a body and K is the thermal diffusivity given by $$\kappa = \frac{k}{\rho C} \tag{2}$$

where k is the thermal conductivity, ρ is the mass density and C is the heat capacity per unit mass.

The heat generation term Θ of Eqn. (1) is given by:

$$\Theta = \frac{\dot{Q}}{\rho C} \tag{3}$$

where $\dot{Q}$ is the power transferred to the earth per unit volume.

In the case of ohmic heating, $\dot{Q}$ is given by:

$$\dot{Q} = \frac{J^2}{\sigma} = \sigma E^2 \tag{4}$$

where J is the electrical current density, E is the electric field, and σ is the electrical conductivity of the medium.

Figure 5A:
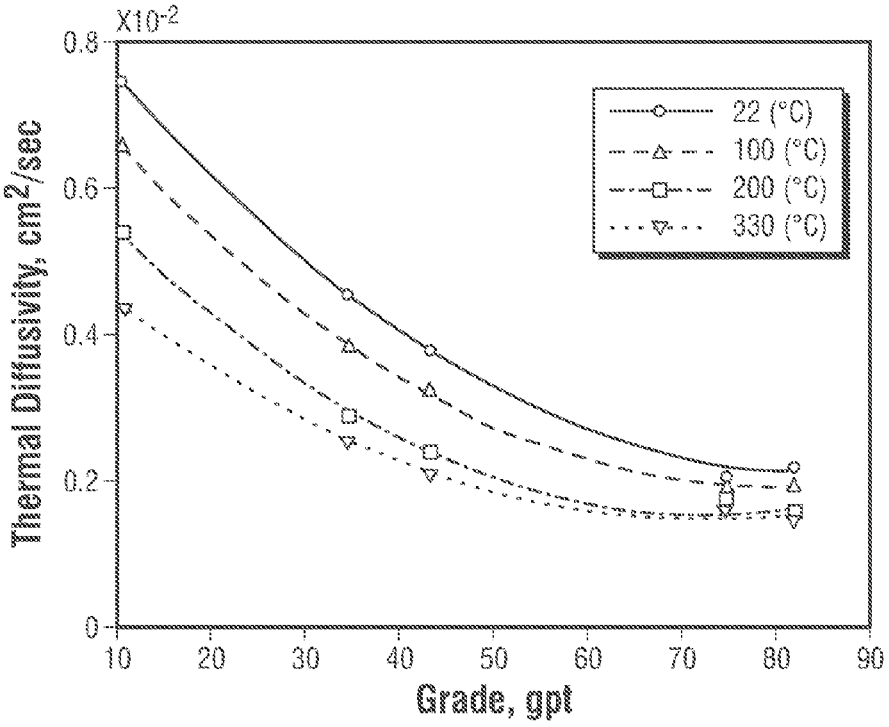
FIG. 5A is a graph illustrating thermal diffusivity of Green River oil shale perpendicular to the bedding planes as a function of temperature.
Figure 5B:
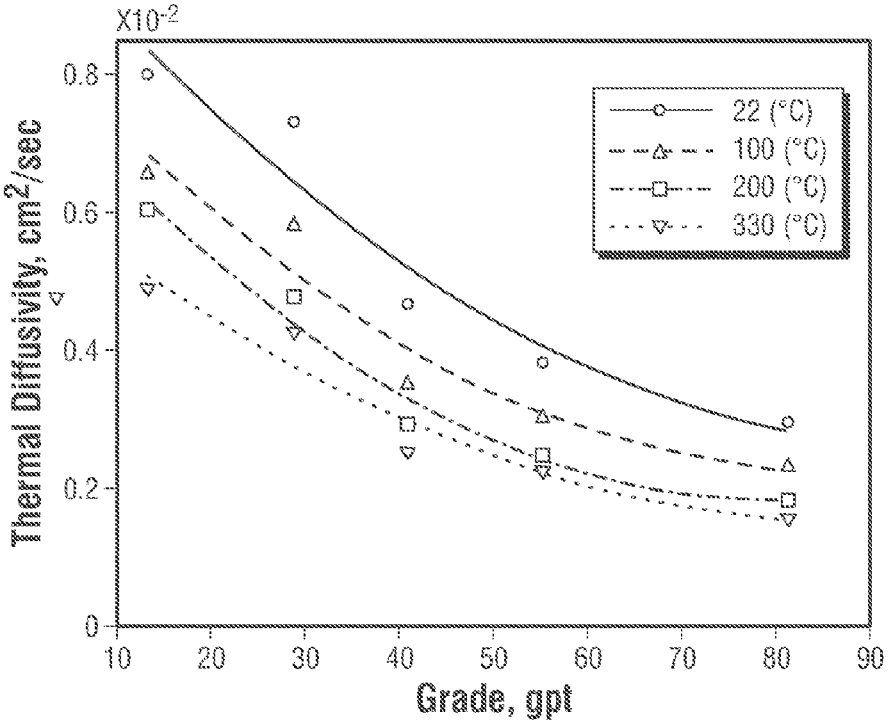
FIG. 5B is a graph illustrating thermal diffusivity of Green River oil shale parallel to the bedding planes as a function of temperature.

Note that the thermal diffusion across the formation can be anistropic in nature. For example, the thermal diffusivity of the Green River oil shale formation has been measured as a function of kerogen content and temperature [Wang et al., 1979] as depicted in FIGS. 5A and 5B. FIG. 5A illustrates the thermal diffusivity of Green River oil shale perpendicular to the bedding planes, while FIG. 5B illustrates the thermal diffusivity of Green River oil shale parallel to the bedding planes. Note that the thermal diffusion is anisotropic across the Green River oil shale formation where heat travels more readily along bedding planes than across them. Also note that thermal conductivity is highest in the leanest formations.

To illustrate the efficacy of the methodology and system of the present application, several deployment schemes have been modeled. In the models, layers with contrasting electrical resistivities have thicknesses of 1 meter each and approximate an oil shale formation with dips of 0°. The electrodes are placed adjacent a formation layer in two wells 10 m apart. For the models, a temperature-independent thermal diffusivity κ of $5\times10^{-7}$ $m^2/s$ has been assumed for all layers. The vadose zone is above the water table. For the Green River oil shale formations, some of the richest pay intervals lie in the vadose zone. To model the vadose zone, the layers are assigned alternating resistivities of 100 ohm-m and 1000 ohm-m. The former are lean zones, having relatively low kerogen content, while the latter are rich zones having relatively high kerogen content. It is especially desirable to heat the rich zones.

Figure 6A:
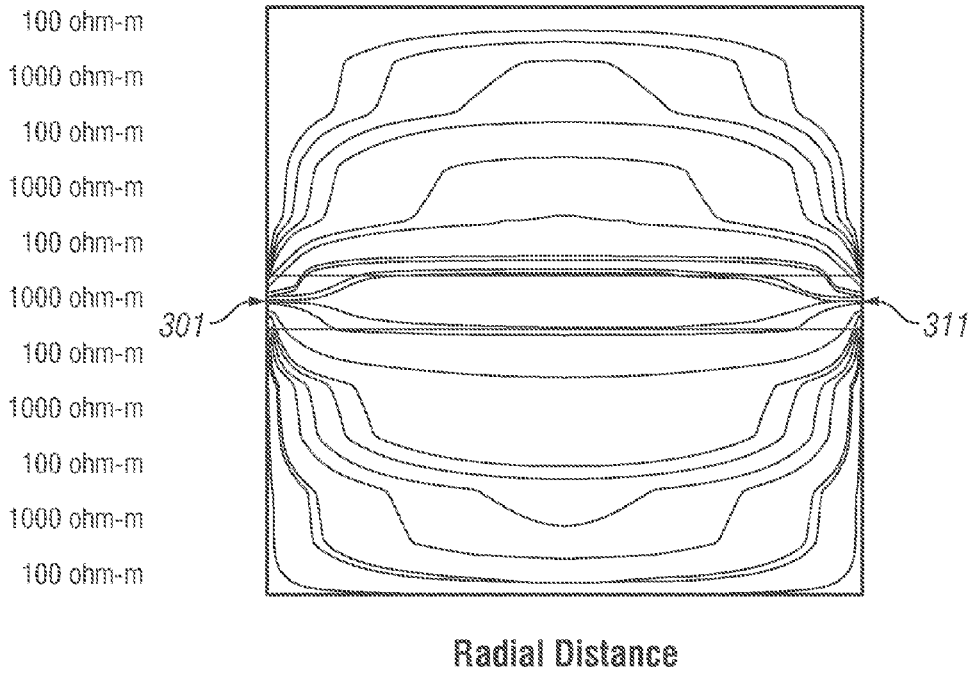
FIGS. 6A and 6B depict the results of exemplary models that simulate the methodology and system of FIG. 3 in a formation with contrasting electrical resistivities have thicknesses of 1 meter each and approximate an oil shale formation with dips of 0°. The electrodes of the downhole tools are placed adjacent a formation layer in two wells 10 m apart. In the model of FIG. 6A, the two electrodes are placed adjacent a rich layer with a high resistivity of 1000 ohm-m in order to inject current flow into and through the rich layer. In the model of FIG. 6B, the two electrodes are placed adjacent a lean layer with a low resistivity of 100 ohm-m in order to inject current flow into and through the lean layer, from which heat diffuses vertically into neighboring rich beds.

FIG. 6A shows a case where the two electrodes are placed adjacent a rich layer with a high resistivity of 1000 ohm-m in order to inject current flow into and through the rich layer. FIG. 6A shows that the current paths between the two electrodes are largely deflected into adjacent lean conductive beds above and below the rich layer and heating is localized near the two electrodes.

Figure 6B:
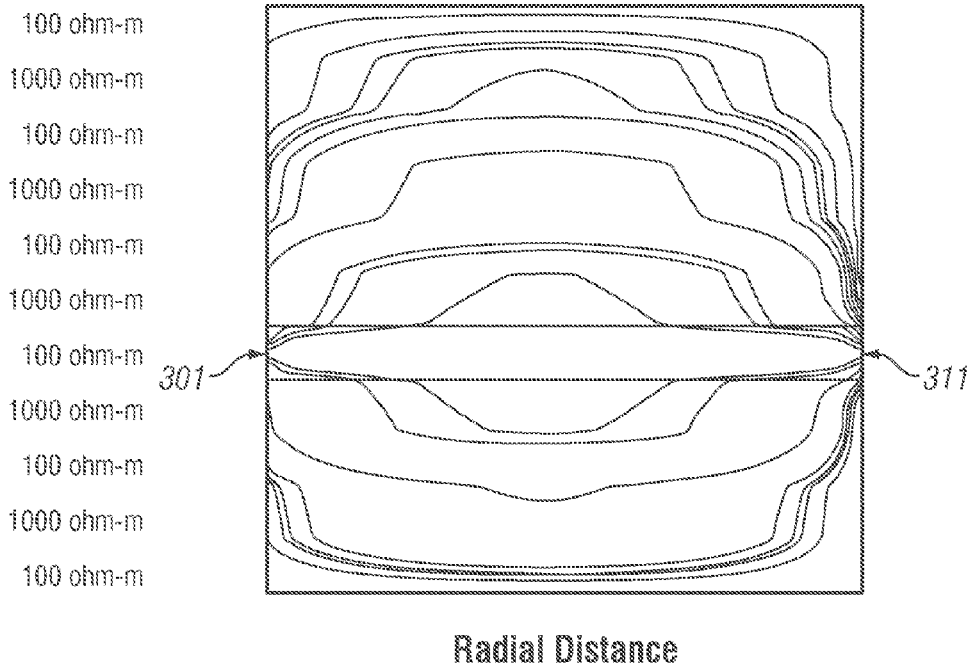

FIG. 6B shows a case where the two electrodes are placed adjacent a lean layer with a low resistivity of 100 ohm-m in order to inject current flow into and through the lean layer. FIG. 6B shows that the current paths between the two electrodes are more focused into the lean layer, and the heating is less localized. Thus, the heat deposition zone has larger extent, from which heat diffuses vertically into neighboring rich beds.

Figure 7A:
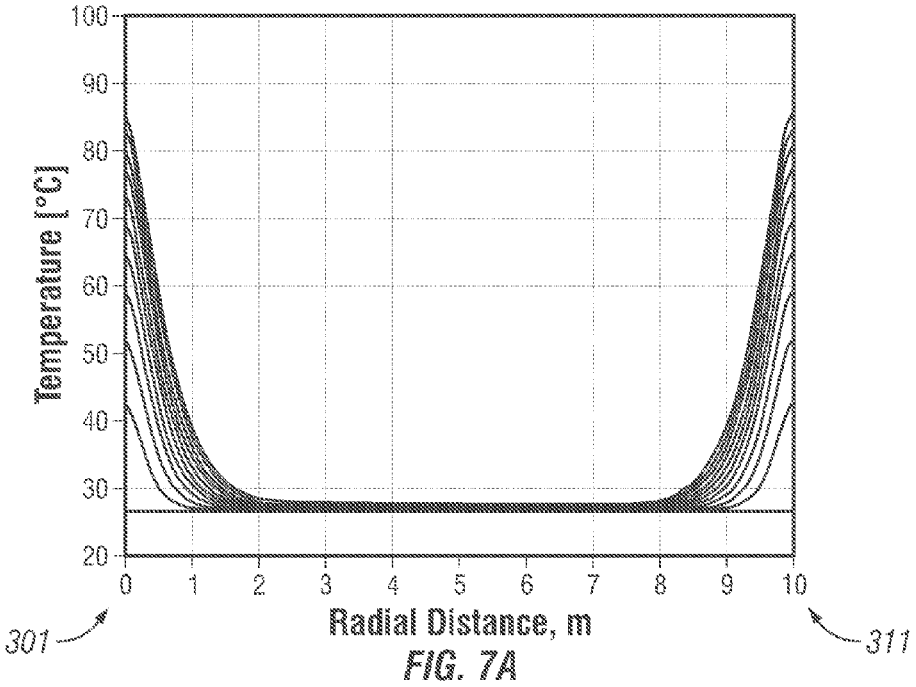
FIG. 7A is a graph showing a temperature profile over time through the center of the rich layer heated by the electrode configuration of the model of FIG. 6A. Each line shows the effect of an additional day of heating.
Figure 7B:
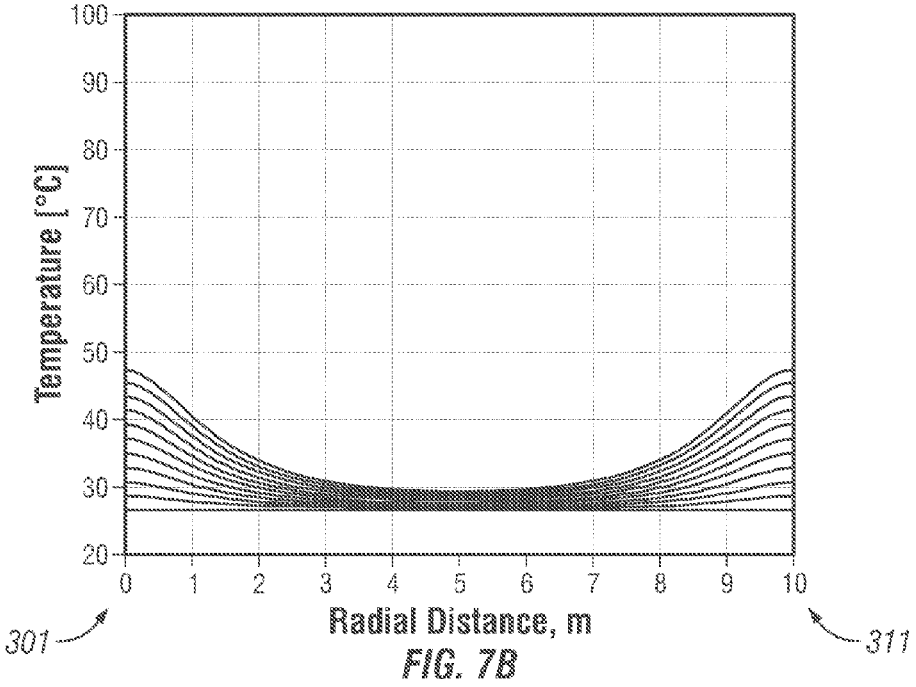
FIG. 7B is a graph showing a temperature profile over time through the center of the rich layer heated by the electrode configuration of the model of FIG. 6B. Each line shows the effect of an additional day of heating.

FIG. 7A shows a temperature profile over time through the center of the rich layer heated by the electrode configuration of FIG. 6A. Each line shows the effect of an additional day of heating. Similarly, FIG. 7B shows a temperature profile over time through the center of the rich layer heated by the electrode configuration of FIG. 6B. Each line shows the effect of an additional day of heating. FIGS. 7A and 7B shows that the heat is better distributed through the rich layer when the electrodes inject current into the adjacent lean layer (FIGS. 6B and 7B) as compared to the configuration when the electrodes inject current into the resistive bed itself (FIGS. 6A and 7A).

Figure 8:
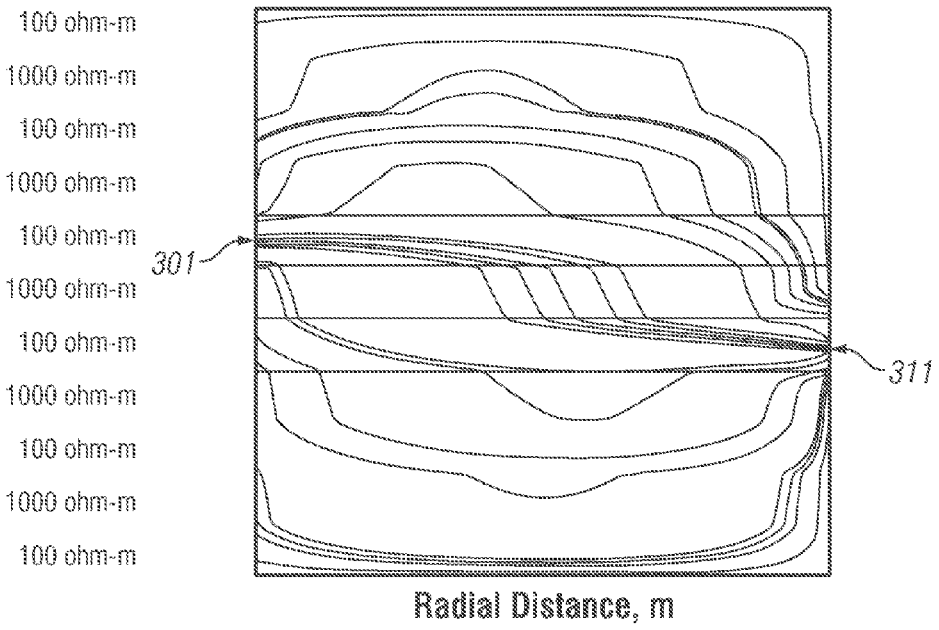
FIG. 8 depicts the results of an exemplary model that simulates the methodology and system of FIG. 3 in a formation with contrasting electrical resistivities have thicknesses of 1 meter each and approximate an oil shale formation with dips of 0°. The two electrodes of the downhole tools are placed adjacent two lean layers with a low resistivity of 100 ohm-m in two wells 10 m apart, where the two lean layers straddle a rich layer with a high resistivity of 1000 ohm-m in order to inject current flow into and through the lean layers and across the adjacent rich layer, from which heat diffuses vertically into neighboring rich beds.
Figure 9:
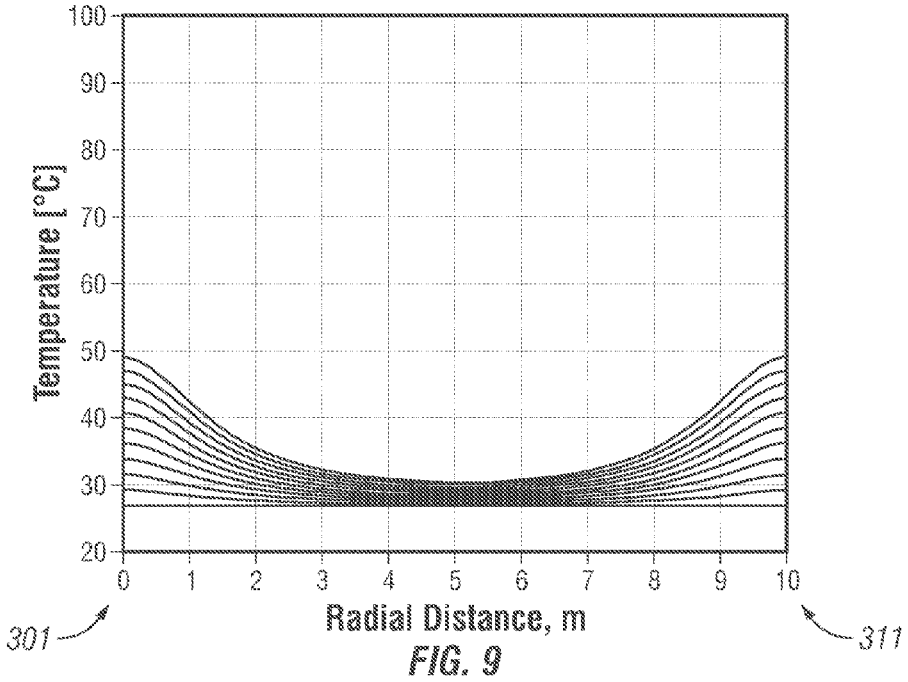
FIG. 9 is a graph showing a temperature profile over time through the center of the rich layer heated by the electrode configuration of the model of FIG. 8. Each line shows the effect of an additional day of heating.

FIG. 8 shows a case where the two electrodes are placed adjacent two different lean layers with a low resistivity of 100 ohm-m that straddle a rich layer of high resistivity of 1000 ohm-m. This electrode configuration is slightly different than the electrode configuration of FIGS. 3 and 6A and 7A. In this configuration, the path of least resistance through the formation (and thus the path for the large part of current flow through the formation between the two electrodes) involves a path generally parallel to bedding through the two adjacent lean layers and crossing the rich layer perpendicular to bedding in such rich layer. FIG. 9 shows a temperature profile over time through the center of the rich layer heated by the electrode configuration of FIG. 8. The distribution of heat in the rich layer is satisfactory as evident from FIG. 9.

Figure 10:
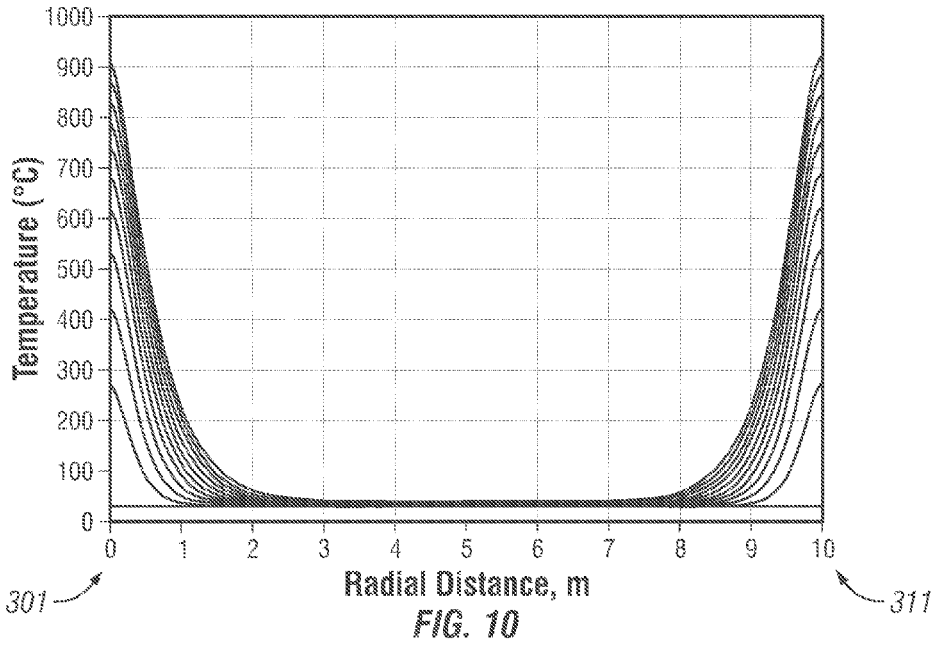
FIGS. 10, 11 and 12 are graphs showing temperature profiles over time for the heating of a saline zone modeled by 1 meter thick layers of alternating resistivities of 10 ohm-m (lean layer) and 50 ohm-m (rich layer). The same electrode configurations were modeled as for the cases of FIGS. 6A, 6B and 8. For each figure, the respective lines show the effect of an additional day of heating.
Figure 11:
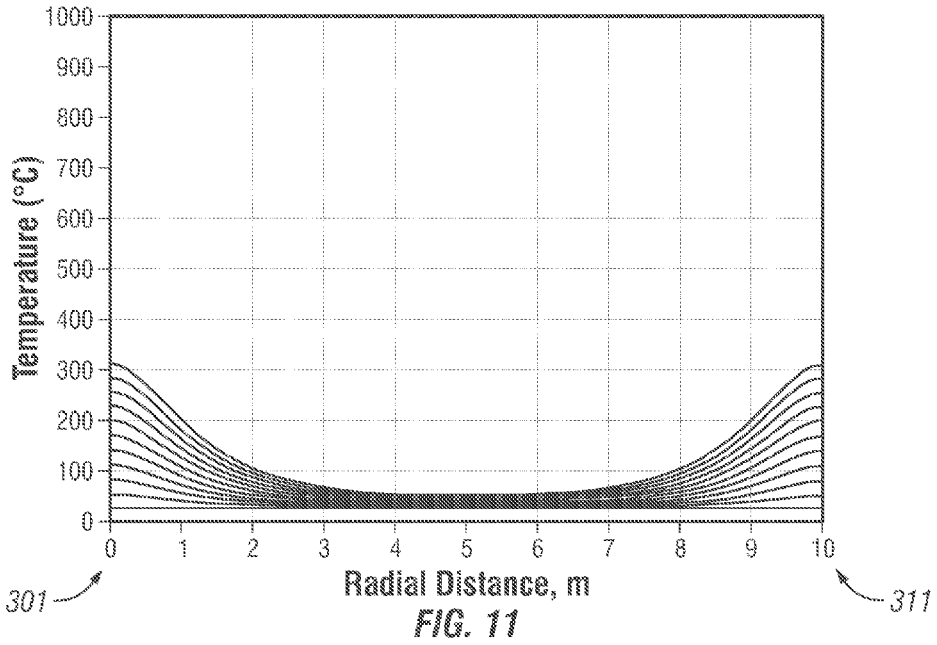
Figure 12:
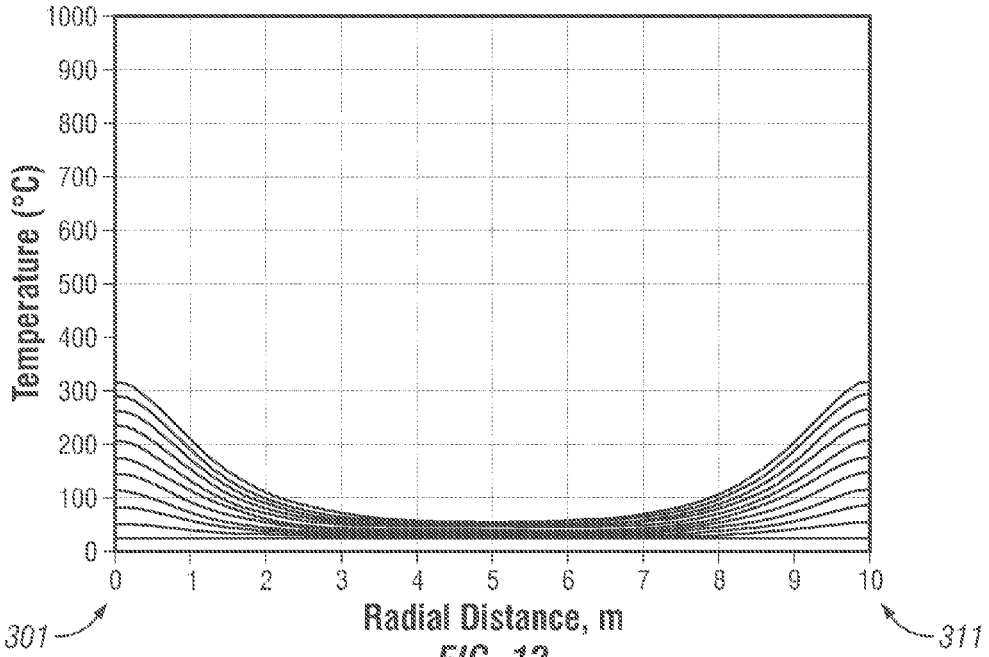

FIGS. 10, 11 and 12 depict the results of heating a saline zone modeled by 1 meter thick layers of alternating resistivities of 10 ohm-m (lean layer) and 50 ohm-m (rich layer). The same electrode configurations were modeled as for the vadose zone cases of FIGS. 6A, 6B and 8. For each figure, the respective lines show the effect of an additional day of heating. Again, heating of the rich layer is more uniform when current is injected into adjacent lean layers, either flowing parallel to the rich layer (FIG. 11) or forced to cross it (FIG. 12).

Figure 13:
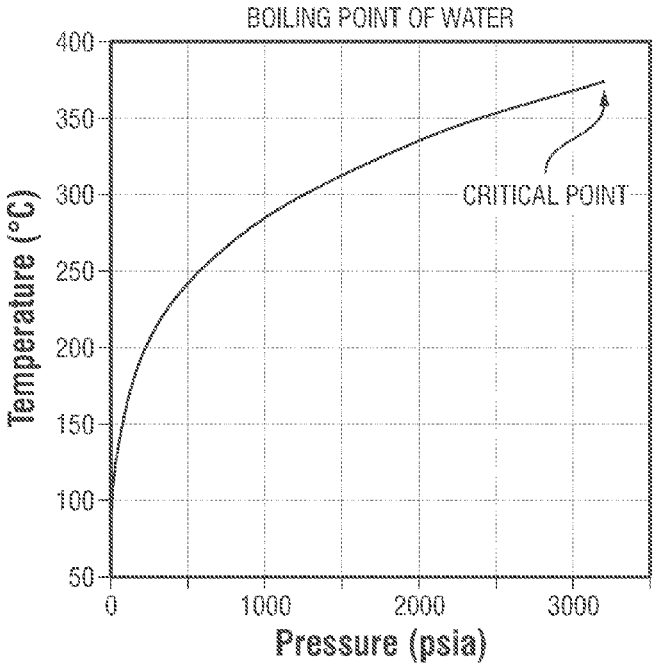
FIG. 13 is a graph showing the boiling point of water as a function of temperature and pressure.

In order to further understand the electrical heating methods utilized in conjunction with connate water, it is necessary to understand how the electrical resistivity of water changes as a function of temperature and pressure. More specifically, increases in temperature to connate water increases the electrically conductivity of the connate water up to a critical point where the water vaporizes in a gaseous phases. Water in the gaseous phase is an electrical insulator. The boiling temperature of the connate water is a function of formation pressure. FIG. 13 shows the boiling point of pure water as a function of pressure as provided by Steam Tables in the CRC Handbook of Chemistry and Physics. The lithostatic pressure gradient in many oil shale and heavy oil formations is approximately 1 psi/ft, and reservoir depths commonly range from a few hundred feet to 3000 ft. At any pressure, salinity of the connate water raises the boiling point. Therefore for the deeper reservoir sections, most, if not all, heating to 350° C. will occur in the presence of liquid water and will not vaporize the connate water. In other embodiments, the AC electrical signal flowing between the two electrodes and the resulting heating temperature of the target interval can be controlled according to the formation pressure of the target interval such that the connate water does not vaporize. As part of such control, one or more downhole pressure sensors can be utilized to characterize formation pressure, and one or more downhole temperature sensors can be utilized to monitor the heating temperature of the target interval. The temperature across the target interval can also be measured by cross-well acoustic measurements. There is rich literature on the temperature dependence of sound propagation in reservoirs, see e.g., B. Gurevich et al., "Modeling elastic wave velocities and attenuation in rocks saturated with heavy oil," Geophysics, 72, E115-E122 (2008), herein incorporated by reference in its entirety. Characteristics of the AC electrical signal flowing between the two electrodes (such as the AC voltage) can be controlled over time such that heating temperature of the target interval remains in a desired range such that the connate water does not vaporize. The control scheme can also monitor the heating temperature of the pay interval to ensure it is within the desired range. For example, the heating temperature across the pay interval can possibly be measured by cross-well acoustic measurements as described above.

Figure 14:
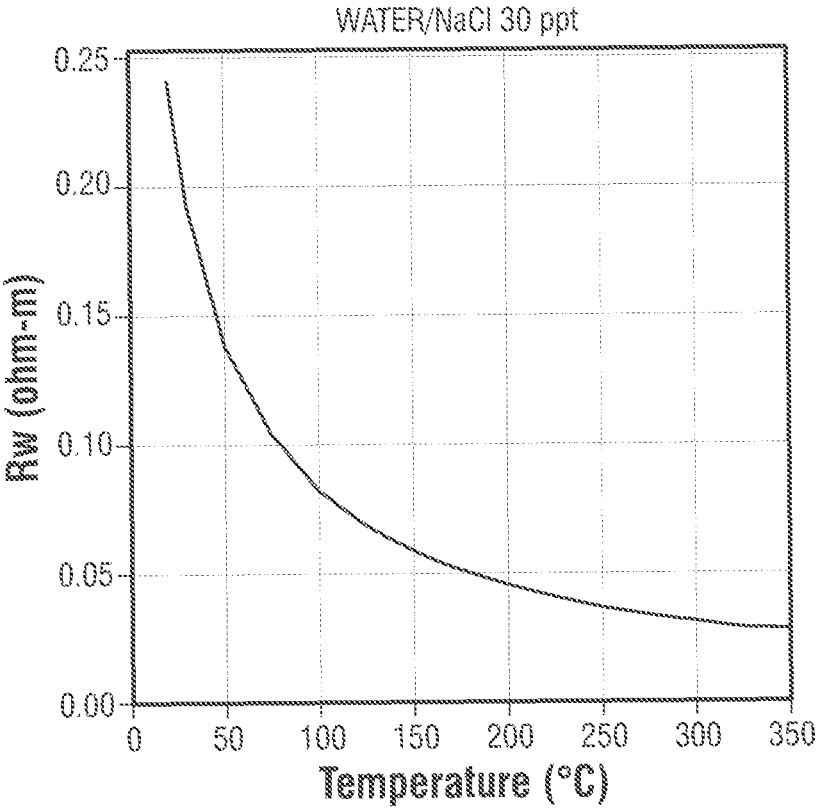
FIG. 14 is a graph showing the resistivity of saline water (water with 30 ppt NaCl) as a function of temperature.

Note that the temperature increases to the connate water due to the heating of the target interval increases the electrical conductivity (decreases the electrical resistance) of the target interval and thus increases the current flow through the target interval and thus further aids in the heating of the target interval. FIG. 14 is a graph that illustrates temperature dependence of the electrical resistance of 30 ppt sodium chloride in water solution as provided by a Schlumberger Log Interpretation Chart Gen-9. The salinity of the 30 ppt sodium chloride and water solution approximates that of sea water and can be analogous to connate water. It should be noted that the salinities of Green River Formation connate waters are highly variable in both composition and concentration, due to the presence of soluble minerals.

For many applications, the electrode configurations can be configured to inject current into one or more lower resistive target intervals that are in closed proximity to the rich pay interval that is desired to be heated. In some applications, computational modeling of the injected current can be utilized. The computational modeling can be used to optimize electrode placement as well as the voltage level (and possibly other properties) of the electrical supply signal generated and supplied by the electrical energy source to the downhole electrodes over time for the desired heating. Specifically, according to Joule's law, the heat injected into the respective target interval is proportional to the square of current flowing through the target interval as well as the electrical resistance of the target interval. The current flowing through the target interval is dependent upon the voltage level of the electrical supply signal and the electrical resistance of the target interval. The electrical resistance of the target interval is dependent upon the conductivity of the target interval and its length, which is dictated by the distance between electrodes. Furthermore, the diffusion of heat from the target interval(s) to the pay interval is dependent upon the thermal conductivity of the formation between the target interval(s) and the pay interval. These properties can be embodied in a computational model for the specific formation of interest along with appropriate boundary conditions. The computation model for the specific formation of interest can be analyzed to optimize the electrode placement and the voltage levels (and possibly other properties) of the electrical supply signal generated and supplied by the electrical energy source to the downhole electrodes over time for the desired heating of the specific formation of interest. The boundary conditions can represent limitations of available power, constraints on the heating process (such as constraints that limit the borehole temperature in order to avoid borehole over-heating), desirable heating profiles over time as well as other suitable process conditions.

In alternate embodiments, different electrode configurations can be used. For example, one of the electrodes can be realized by a casing string or insulated section of a casing string. In another example, the two electrodes can be spaced apart in a single wellbore (such as a u-shaped wellbore). In yet another example, more than two wellbores and downhole tools with associated current injection electrodes can be arranged in an array over the formation to provide a desired heating pattern.

Advantageously, the method and system of the present application provides for efficient and effective in-situ conversion of kerogen into shale oil and gas phase hydrocarbons suitable for production. These products can be a good quality refinery feedstock requiring no further upgrading. Moreover, waste products remain underground, minimizing environmental impacts.

In another aspect of the invention, the system and methodology as described above can be adapted to provide for in-situ heating of heavy oil of a subterranean formation through heating of at least one adjacent lower resistance zone of the formation. The heating is accomplished by AC current injection into and through the adjacent lower resistance zone(s). The heat deposited into the adjacent lower resistance zone(s) is transferred by conduction (also referred to as "diffusion") to the heavy oil zone in order to heat the heavy oil and reduce its viscosity to aid in production. For these applications, the target interval(s) for the heating would be an interval of relatively high water saturation (and low heavy oil saturation) that is adjacent or otherwise proximate to the heavy oil pay interval. Advantageously, these operations can be effectively and efficiently carried out in deepwater heavy oil plays where traditional steam-assisted heavy oil recovery is infeasible. The reduced viscosity oil can be produced from the formation employing a suitable production methodology. The production methodology can employ one or more horizontal production wells that allow for production of the reduced viscosity oil from the formation. Alternatively, the wellbore(s) that contain the current injection tools can be configured to provide for production of the reduced viscosity oil from the formation.

There have been described and illustrated herein several embodiments of a method and system for electrical heating of oil shale and heavy oil formations. While particular embodiments of the invention have been described, it is not intended that the disclosure be limited thereto, as it is intended that it be as broad in scope as the art will allow and that the specification be read likewise. It will therefore be appreciated by those skilled in the art that modifications could be made. Accordingly, all such modifications are intended to be included within the scope of this disclosure as defined in the following claims. In the claims, means-plus-function clauses, if any, are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method of enhancing production of hydrocarbons from a subterranean formation having a plurality of intervals, the method comprising:

identifying first and second distinct target intervals that straddle a pay interval, wherein the target intervals each have an electrical resistance less than an electrical resistance of the pay interval;

positioning a plurality of electrodes spaced apart from one another and each disposed adjacent to at least one of the target intervals, wherein a first electrode of the plurality of electrodes is disposed adjacent the first distinct target interval and a second electrode of the plurality of electrodes is disposed adjacent the second distinct target interval;

injecting electrical current into the target interval by supplying electrical signals to the electrodes, wherein the electrical current passes through a portion of the target intervals to heat the pay intervals; and producing hydrocarbons from the pay interval.

2. A method according to claim 1, wherein the electrodes are supported by corresponding downhole tools that are located in distinct wellbores at positions adjacent the target intervals.

3. The method according to claim 2 wherein the distinct wellbores each extend through the first and second target intervals and wherein the first and second target intervals are disposed on opposite sides of the pay interval.

4. A method according to claim 1, wherein a large portion of the electrical current flows through the formation along a path that extends generally parallel to bedding of the target interval.

5. A method according to claim 1, wherein the electrodes are supported by corresponding downhole tools that are located in respective wellbores each extending through the target intervals.

6. A method according to claim 5, wherein at least one of the electrodes includes an element that extends through mudcake lining a wellbore and into an invaded zone of the target interval.

7. A method according to claim 5, wherein at least one of the downhole tools includes a pad that is configured to contact mudcake lining the respective wellbore and to surround a corresponding electrode during current injection operations.

8. A method according to claim 1, wherein the electrical signals comprise AC electrical signals having a frequency less than 100 HZ.

9. A method according to claim 8, wherein the AC electrical signals have a frequency of about 50 Hz to about 60 Hz.

10. A method according to claim 1, wherein the pay interval includes at least one of kerogen and heavy oil, and the heating of the pay interval converts in-situ the kerogen of the pay interval to shale oil and hydrocarbon gases or reduces in-situ the viscosity of the heavy oil.

11. A method according to 1, wherein the first distinct target interval holds connate water and the heating of the first distinct target interval is controlled to not vaporize the connate water.

12. A method according to claim 1, wherein the heating of at least one of the target intervals and the pay interval over time is controlled according to temperature measurements of the formation over time.

13. A method according to claim 12, wherein the temperature measurements are derived by cross-well acoustic measurements.

14. A method according to claim 1, further comprising performing computational modeling of the injected current to optimize electrode placement and/or properties of the electrical signals supplied to the plurality of electrodes.

15. A method of enhancing production of hydrocarbons from a subterranean formation having a plurality of intervals, comprising:

identifying a target interval of the subterranean formation that is in proximity to a pay interval of kerogen, wherein the target interval has an electrical resistance less than a pay interval electrical resistance;

positioning electrodes in positions spaced apart from one another and at a depth within the target interval, wherein the electrodes are supported by corresponding downhole tools that are located in respective wellbores each extending through the target interval, wherein at least one of the electrodes extends through mudcake lining a respective wellbore and into an invaded zone of the target interval, and wherein the at least one electrode extends through the invaded zone and into an uninvaded zone of the target interval;

injecting electrical current into the target interval by supplying electrical signals to the electrodes, wherein the electrical current injected into the target interval passes through a portion of the target interval to heat the target interval and heat the pay interval to a temperature to convert in-situ the kerogen of the pay interval to shale oil and hydrocarbon gases; and producing the shale oil and hydrocarbon gases from the formation.

16. A method according to claim 15, wherein at least one of the downhole tools includes a pad that is configured to contact mudcake lining a respective wellbore and to surround a corresponding electrode during current injection operations.

17. A method according to claim 15, wherein the electrical signals comprise AC electrical signals having a frequency less than 100 HZ.

18. A method according to claim 17, wherein the AC electrical signals have a frequency in the range of 50 Hz to 60 Hz.

19. A method according to claim 15, further comprising performing computational modeling of the injected current to optimize electrode placement for the desired heating and/or properties of the electrical signals supplied to the plurality of electrodes for the desired heating.

20. A system of enhancing production of hydrocarbons from a subterranean formation having intervals, comprising:

downhole tools traversable within at least one wellbore that intersects a target interval of the subterranean formation, wherein the target interval is in proximity to a pay interval of kerogen, wherein the at least one target interval has an electrical resistance less than electrical resistance of the pay interval, wherein at least one of the downhole tools has an electrode that has a configuration where the electrode extends through mudcake lining the at least one wellbore and into an invaded zone of the at least one target interval, and wherein the electrode extends through the invaded zone and into an uninvaded zone of the target interval;

an electrical energy source that is configured to supply electrical signals to said plurality of electrodes in order to inject electrical current into the at least one target interval, wherein the electrical current injected into the at least one target interval passes through at least a portion of the at least one target interval in order to heat the at least one target interval and heat the pay interval by thermal conduction to a sufficient temperature to convert in-situ the kerogen of the pay interval to shale oil and hydrocarbon gases for producing the shale oil and hydrocarbon gases from the formation.

21. The method according to claim 15 wherein the electrodes are positioned adjacent two distinct target intervals that straddle the pay interval.

* * * * *